US009155928B2

(12) United States Patent
Vilas Blanco et al.

(10) Patent No.: US 9,155,928 B2
(45) Date of Patent: Oct. 13, 2015

(54) CONTROL SYSTEM FOR FIRE PREVENTION FACILITIES

(71) Applicants: Carolina Vilas Blanco, Saragossa (ES); Hector Gil San Jose, Saragossa (ES)

(72) Inventors: Carolina Vilas Blanco, Saragossa (ES); Hector Gil San Jose, Saragossa (ES)

( * ) Notice: Subject to any disclaimer, the term of this patent is extended or adjusted under 35 U.S.C. 154(b) by 111 days.

(21) Appl. No.: 13/941,672

(22) Filed: Jul. 15, 2013

(65) Prior Publication Data

US 2014/0020914 A1 Jan. 23, 2014

(30) Foreign Application Priority Data

Jul. 19, 2012 (EP) ..... 12382288
Mar. 8, 2013 (EP) ..... 13382078

(51) Int. Cl.
*A62C 37/50* (2006.01)
*A62C 11/00* (2006.01)

(52) U.S. Cl.
CPC ..... *A62C 37/50* (2013.01)

(58) Field of Classification Search
CPC ..... A62C 37/38; A62C 37/40; A62C 37/42; A62C 37/50; A62C 37/58; A62C 11/00; A62C 35/58
USPC ..... 340/539.1, 539.16, 539.17, 531, 568.1, 340/611, 612, 614; 169/23, 30, 75; 455/456, 456.3, 456.6
See application file for complete search history.

(56) References Cited

U.S. PATENT DOCUMENTS

| | | | | |
|---|---|---|---|---|
| 4,987,783 | A * | 1/1991 | D'Antonio et al. | 73/432.1 |
| 5,950,150 | A | 9/1999 | Lloyd et al. | |
| 5,982,274 | A | 11/1999 | Stelter et al. | |
| 6,279,664 | B1 | 8/2001 | Yanovsky et al. | |
| 7,081,815 | B2 * | 7/2006 | Runyon et al. | 340/541 |
| 7,450,020 | B2 * | 11/2008 | McSheffrey et al. | 340/614 |
| 8,842,016 | B1 * | 9/2014 | Cazanas et al. | 340/611 |
| 2005/0056090 | A1 | 3/2005 | McSheffrey, Jr. et al. | |
| 2006/0283608 | A1 | 12/2006 | Hauck | |
| 2006/0288101 | A1 * | 12/2006 | Mastrodonato et al. | 709/224 |

FOREIGN PATENT DOCUMENTS

| | | |
|---|---|---|
| CN | 201893012 | 7/2011 |
| WO | 2010/035150 | 4/2010 |

OTHER PUBLICATIONS

European Search Report dated Dec. 12, 2012 in corresponding European Patent Application No. 12382288.4.
European Search Report dated Aug. 27, 2013 in corresponding European Patent Application No. 13382078.7.

* cited by examiner

*Primary Examiner* — Hung T Nguyen
(74) *Attorney, Agent, or Firm* — Wenderoth, Lind & Ponack, L.L.P.

(57) ABSTRACT

A control system for fire prevention facilities is provided, particularly for the type of facilities mounted on buildings and warehouses mounting at least one pressure group and/or one equipped fire hydrant and/or one fire extinguisher. The control system comprises at least one pressure group and at least one equipped fire hydrant with a pressure gauge provided with a LED light and communication means, via radio or wiring, as well as at least one fire extinguisher equipped with a pressure gauge provided with a LED light and communication means, via radio or wiring; a control center with, at least one computer and a database.

2 Claims, 5 Drawing Sheets

CONTROL SYSTEM FOR FIRE PREVENTION FACILITIES

BACKGROUND OF THE INVENTION

1. Field of the Invention

The present specification describes a control system for fire prevention facilities, which is applicable for installation in all types of buildings, and thus, applies in public institutions, shopping malls, health and educational centers, and residential buildings, as well as in all types of businesses and industrial warehouses.

2. Description of Related Art

As it is known, with the passage of time security measures in general and, in particular as regards fire prevention, have been improving with the object of minimizing the risk thereof.

Thus, the different components of a fire protection facility such as the pressure group, the equipped fire hydrants and the fire extinguishers are provided with gauges that allow a user to know that the pressure is correct and for this regular reviews are carried out.

Despite this, at any time a pressure leak may occur rendering the corresponding component useless, not being aware of it until an "in situ" inspection is performed, such that if said component had to be used during that interval of time it will not be possible, and this may have fatal consequences.

This problem becomes more serious in those rooms of the facility that are closed having restricted access and that are only tested when the corresponding review of the facility is carried out by the maintenance services, so they may be useless and this is not detected until the review is carried out. Thus, the discharge of automatic fire extinguishers can occur in burners or boilers wherein no one accesses until the review is carried out and therefore said area is unprotected.

Likewise, it may also be the case that the pressure group does not have the correct pressure such that there will not be enough pressure in the event of use of the equipped fire hydrants, with the added inconvenient that by not having the correct pressure the pumps operate without sufficient pressure and they can be damaged and the facility remains unprotected.

Similarly, the fire extinguishers may lose pressure, may be discharged or may be stolen, leaving the area unprotected and so that, typically, there is no record of this until a review is carried out. Exceptionally, there might be the case that, in those components that are within sight, such as fire extinguishers, someone will realize the lack of pressure or even the lack of some fire extinguisher and can give warning, although these are very sporadic situations.

On the other hand, an inadequate maintenance can be provided by the maintenance company of the facility, by neglect or lack of the corresponding item, and therefore not being in working conditions.

In short, the real fact is that although there can be a fire protection facility properly mounted, it may occur that it is not in the appropriate working conditions and therefore, in the case of having to use the same, it does not fulfil its function.

Notwithstanding the foregoing, an existing problem is that in the case of theft or loss of a safety pin of the actuating lever of the fire extinguishers there are no means that allow knowing this, so that, in these circumstances, the fire extinguishers can lose pressure and extinguishing agent and, with this, efficiency or rendering them inoperative.

BRIEF SUMMARY OF INVENTION

The following invention, as expressed in the statement of the present specification, relates to a control system for fire prevention facilities, the fire prevention facilities being of the type which are mounted in all types of buildings and warehouses that mount at least one pressure group and/or at least one equipped fire hydrant and/or at least one fire extinguisher, with corresponding function means, so that the essential object is to continuously and automatically control that the pressure of all the components of the facility is correct and that the fire extinguishers are at their place of location.

Thus, in a control center the proper state of all the components of the fire protection facility is continuously being monitored of and at the moment that a failure occurs it is known instantly in order to be able to act accordingly with the object of rectify said failure.

In addition another objective is to monitor that the safety pins of the actuating lever of the fire extinguishers have not been tampered with.

Likewise, the pressure gauges of the different components of the facility include wireless transmission (e.g., Bluetooth®) with the object of being able to obtain "in situ", in the technical periodic maintenance by using tablet, mobile telephones, PDA or similar, the information concerning the status of the pressure gauge.

DETAILED DESCRIPTION OF INVENTION

Figure 1:
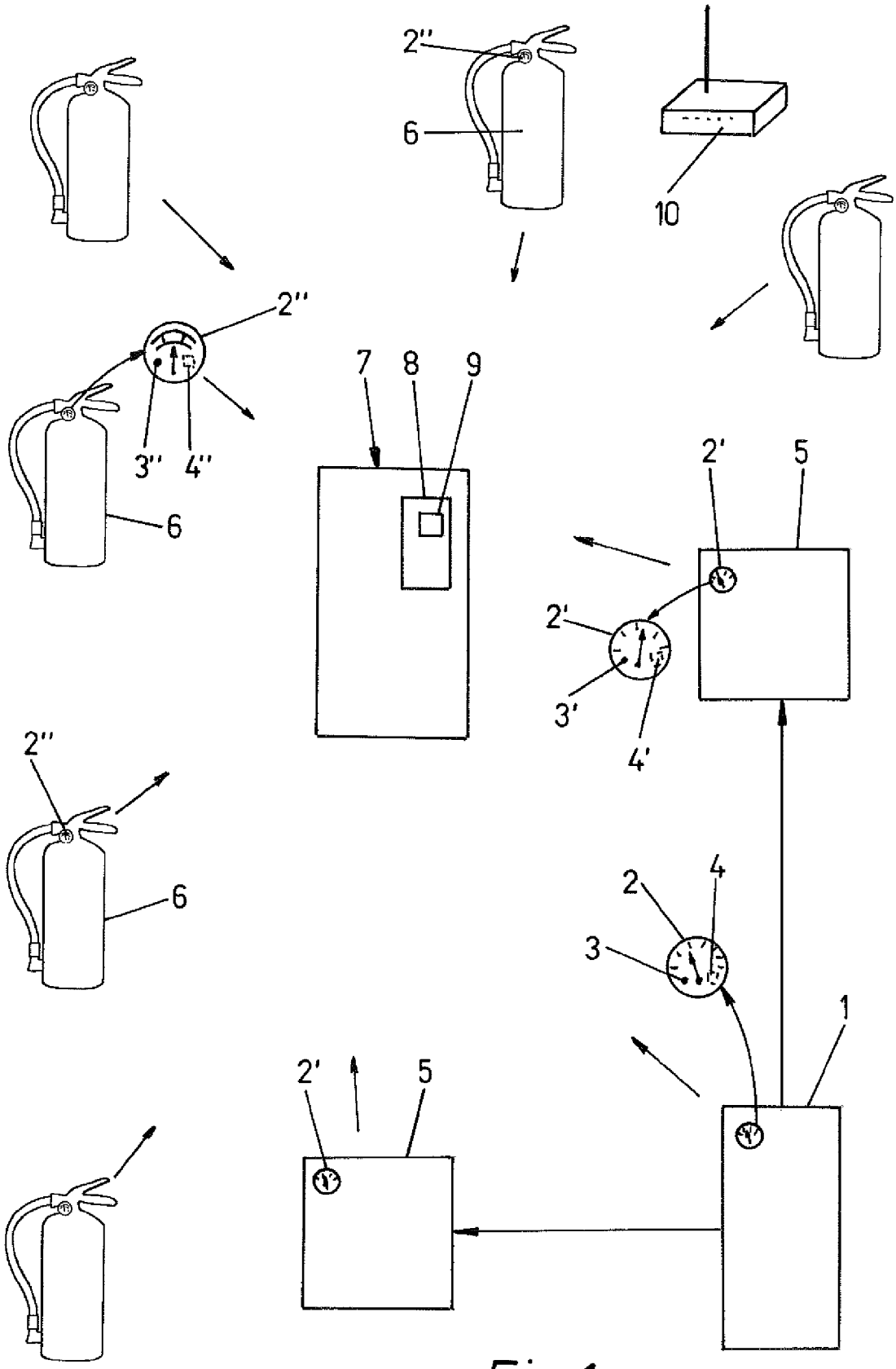
FIG. 1 shows a schematic view of a simple practical implementation of a fire prevention facility consisting of a pressure group, two equipped fire hydrants and a set of fire extinguishers, which are communicated via radio with a control center.
Figure 2:
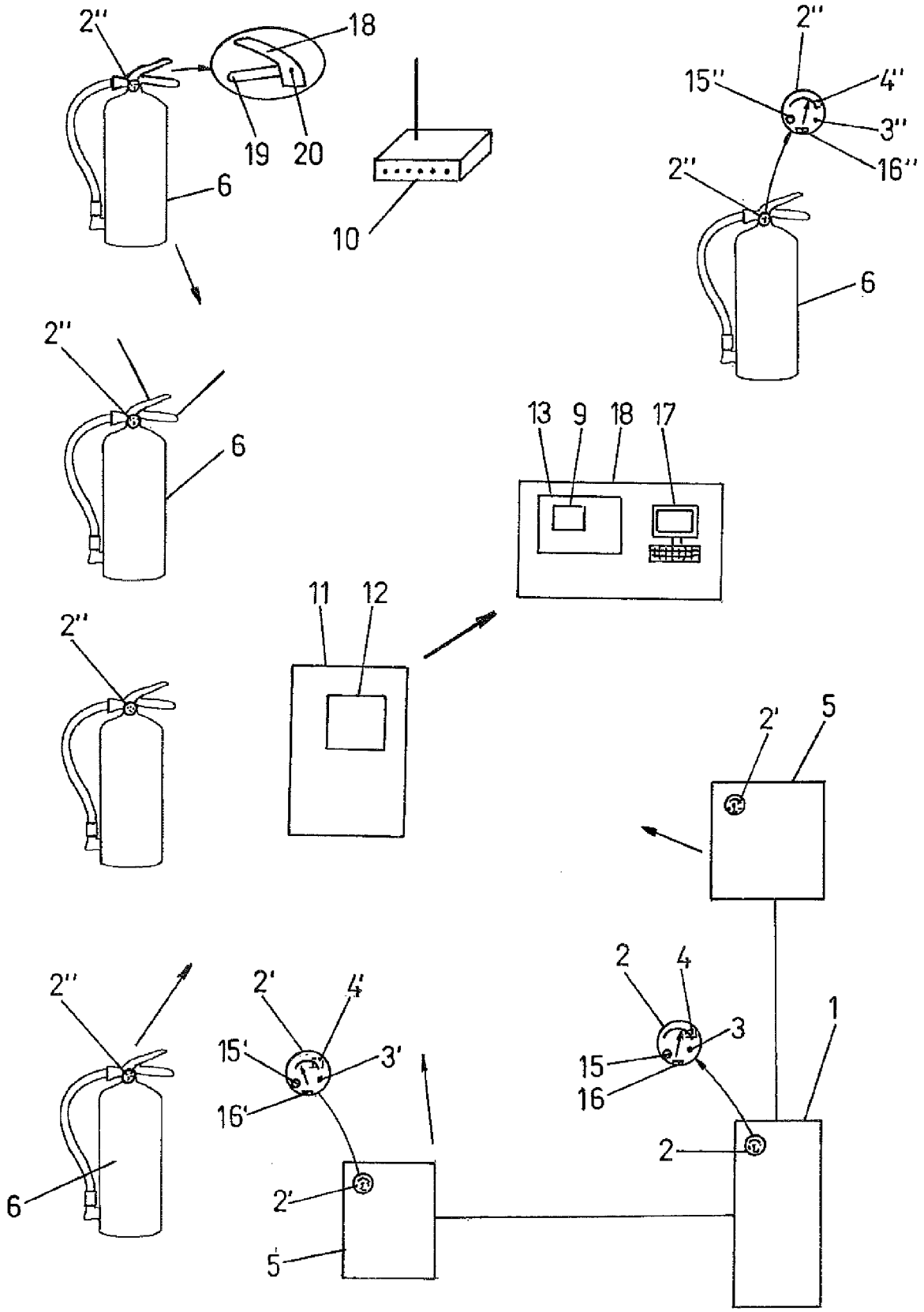
FIG. 2 shows a schematic view of a another embodiment of the invention where the practical implementation of a fire protection facility formed by a pressure group, two equipped fire hydrants and a series of fire extinguishers that are communicated via radio with a control station.
Figure 4:
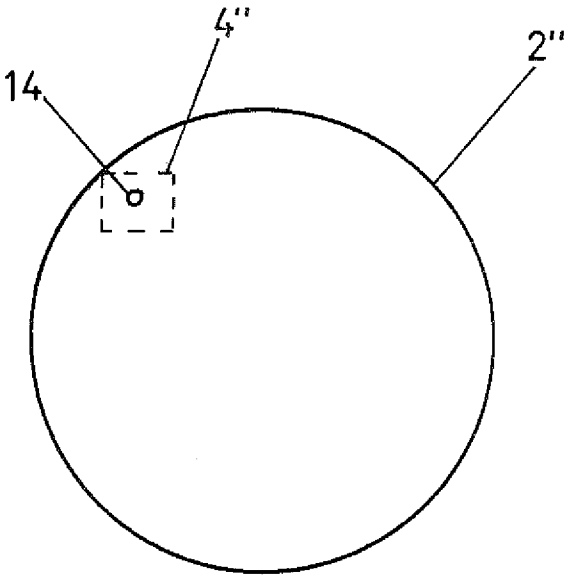
FIG. 4 shows a rear view of the pressure gauge of the previous figure and it can be seen how the same is provided with a small hole in which the safety pin or an element linked to the same fits, to be able to control a possible release of the safety pin.
Figure 3:
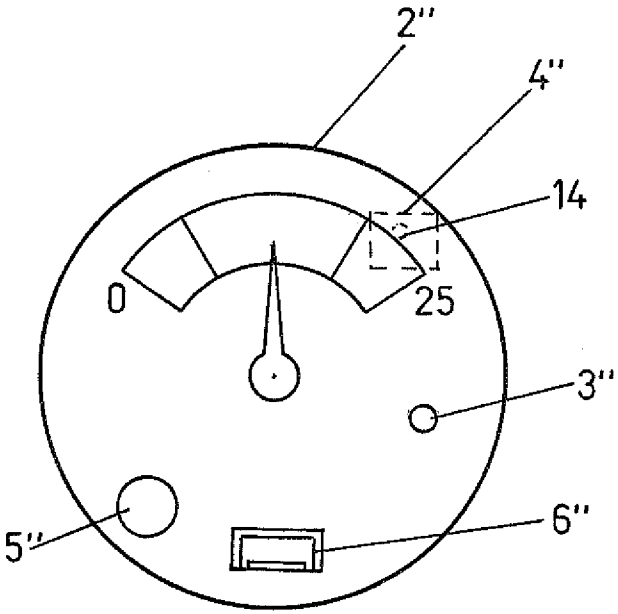
FIG. 3 shows a front view of a pressure gauge relating to a fire extinguisher provided with a LED light, communication via radio, a battery and wireless transmission (e.g., Bluetooth®) and which is associated to the safety pin of the same.
Figure 5:
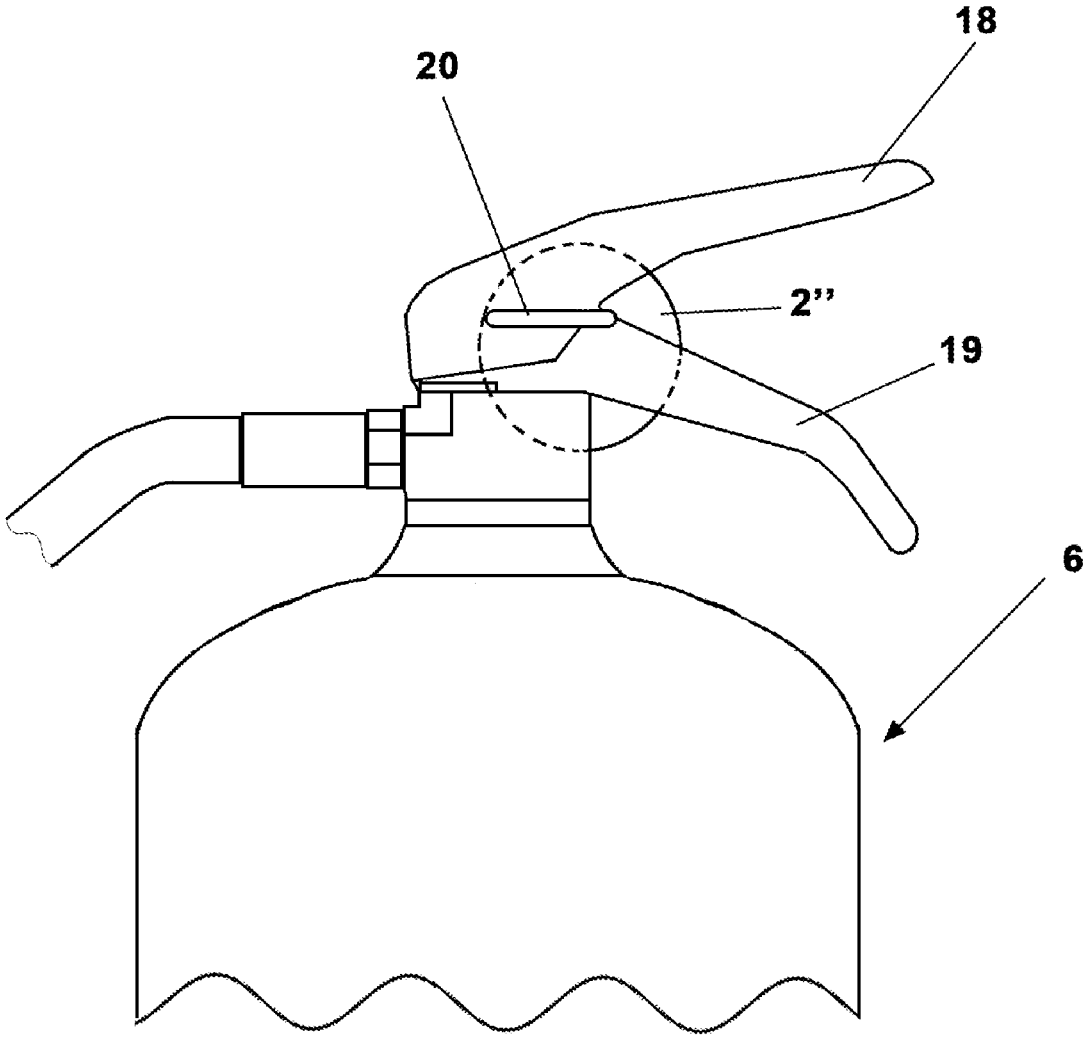
FIG. 5 shows a front view of the pressure gauge of the previous figure and it can be seen how the same is provided with the safety pin or an element linked to the same.
Figure 6:
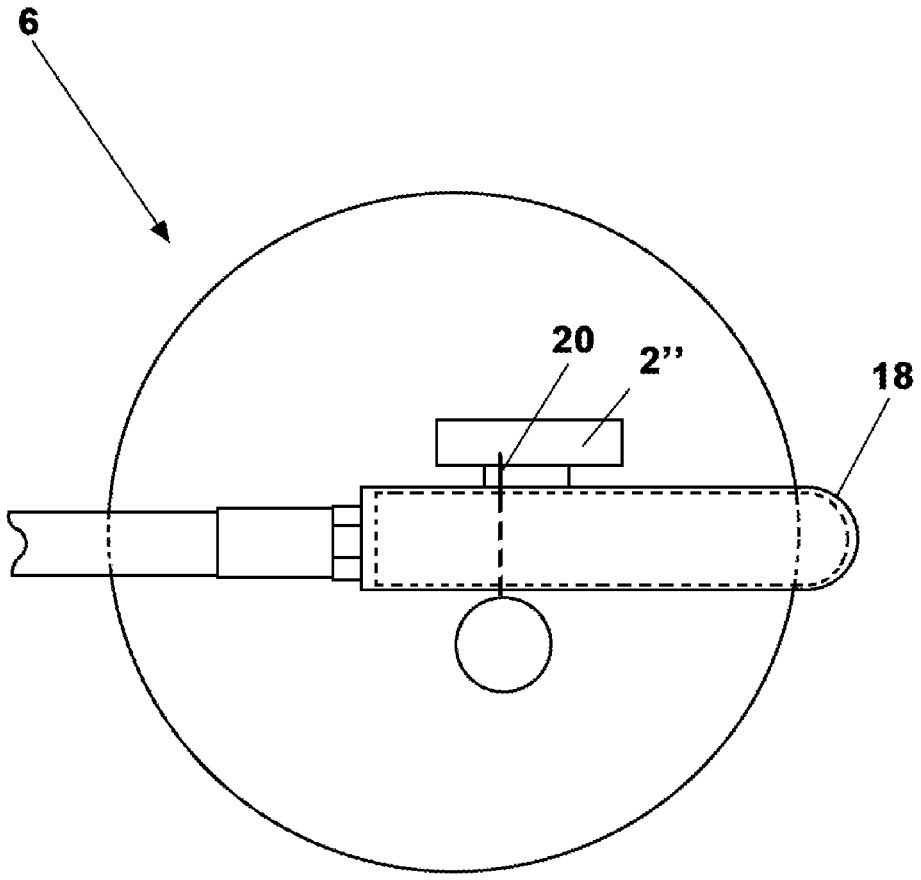
FIG. 6 shows a top view of the pressure gauge of the previous figure and it can be seen how the same is provided with a small hole in which the safety pin or an element linked to the same fits, to be able to control a possible release of the safety pin.

With the object of solving the aforementioned problems, the present specification describes a control system for fire prevention facilities, the fire prevention facilities being of the type of facilities which have, at least one pressure group and/or, at least one equipped fire hydrant and/or, at least one fire extinguisher, allowing to know instantly any malfunction of the same, such that the system comprises:

- at least one pressure group equipped with a pressure gauge provided with a LED light and communication means, via radio or wiring;
- at least one equipped fire hydrant provided with a pressure gauge provided with a LED light and communication means, via radio or wiring;

at least one fire extinguisher equipped with a pressure gauge provided with a LED light and communication means, via radio or wiring;

a control center with, at least one computer receiving information from the components of the facility and that is connected to the fixed or mobile telephone network, and;

a storage database of the plan of the facility with the situation of the different components of the same.

In this way, as soon as the pressure falls below a default value the warning LED light will turn on having a visual information of a lack of pressure and in addition, a communication via radio or other equivalent means will be sent to the control center informing of the detected malfunction so that it can be instantly repaired.

Also, if, for example, a fire extinguisher is moved from its place of location, also, a communication via radio or other equivalent means will be sent to the control center, allowing a person to immediately verify the reason why it has been taken.

In those fire protection facilities that cover a large area and have numerous components there could be some radio relay station.

Thus, the control system enables a continuous control of the fire prevention facility to ensure the good condition of the same, which allows that all the components are in perfect state of use.

On the other hand, the present invention comprises:

at least, one pressure group equipped with a pressure gauge provided with a LED light and means of communication via radio or wiring;

at least, one equipped fire hydrant equipped with a pressure gauge provided with a LED light and means of communication via radio or wiring;

at least, one fire extinguisher equipped with a pressure gauge provided with a LED light and means of communication via radio or wiring;

a control center with, at least, one monitoring station responsible for receiving the warning signal from the various components of the facility;

a warning receiving center that comprises, at least, one computer receiving information about the components of the facility from the monitoring station of the control center via SMS, e-mail or telephone; the warning receiving center is connected to the mobile or land telephone network, and the receiving center may be in the facilities of the client or in the maintenance company, and;

a storage database of the plane of the facility with the location of the different components of the same, such that the system consisting in that:

the pressure gauges of all the components of the facility relating to pressure groups, equipped fire hydrants and fire extinguishers, are provided with a power supply battery and include wireless transmission (e.g., Bluetooth®), and;

the safety pin of the actuating lever of the fire extinguishers is directly associated with the corresponding pressure gauge of the same.

Thus, in a first practical implementation, the safety pin, associated with the pressure gauge is inserted, by one of its ends, in a small hole of the pressure gauge itself in contact with the means of communication.

In a second practical implementation, the safety pin, associated with the pressure gauge, will be connected to the same by means of a metallic or non-metallic element, e.g. a wire or strand, inserted in a small hole of the pressure gauge itself in contact with the means of communication.

In this way, in addition to the different benefits already listed through the association of the safety pin to the pressure gauge means, it is provided the additional advantage of being able to control if the safety pin has been tampered with, primarily, if the same has been released, thus leaving the actuating lever of the fire extinguisher free, such that it may be accidentally operated and the fire extinguisher could lose effectiveness or could be discharged.

Likewise, by incorporating all the pressure gauges of the different components of the facility with wireless transmission (e.g., Bluetooth®), the technical periodic maintenance may be carried out through a tablet, mobile telephone, PDA or the like in order to obtain the information concerning the status of the pressure gauges "in situ".

Thus, the control system allows continuous monitoring of the fire protection facility for checking the good condition of the same, which allows that all the components are in perfect state of use.

To complement the description that will be carried out next, and with the object of helping to a better understanding of the features of the invention, the present specification is accompanied by a set of drawings, in the figures of which are represented the most characteristic details of the invention in an illustrative manner and without limitation.

To complement the description that will be carried out in the following, and with the object of helping to a better understanding of the features of the invention, the present specification is accompanied by a set of plans, the figures of which represent, in an illustrative manner and without limitation, the most characteristic details of the invention.

MODE OF OPERATION OF INVENTION

In view of the aforementioned figure and according to the adopted numbering it can be observed as the fire prevention facilities control system is applicable in all kinds of fire prevention facilities that have, at least one pressure group, and/or, at least one equipped fire hydrant and/or, at least one fire extinguisher, such that the system is based on providing the gauges of the different components of the facility with a LED light and with communication means, via radio or other equivalent means.

Moreover, the control facility has a control center 7 with at least one computer 8 which receives information from the various components of the facility and it is connected to the fixed or mobile telephone network, having at least one storage database 9 of the plan of the facility to be controlled with the location of the different components of the same.

Thus, according to FIG. 1, the pressure group 1 is equipped with a pressure gauge 2 provided with a LED light 3 and communication means 4, via radio, so that if the pressure of the same is below a given parameter the warning LED light 3 will turn on and the communication means 4, via radio, will send a communication to the computer 8, in real time, notifying the incidence produced and being able to act accordingly.

Also, the equipped fire hydrants 5 are equipped with a pressure gauge 2' provided with a LED light 3' and communication means 4', via radio, so that if the pressure of the same is below a given parameter the warning LED light 3' will turn on and the communication means 4', via radio, will send a communication to the computer 8, in real time, notifying the incidence produced and being able to act accordingly.

Likewise, the different fire extinguishers 6 of the facility are equipped with a pressure gauge 2" provided with a LED light 3" and communication means 4", via radio, so that if the pressure of the same is not adequate the warning LED light 3"

will turn on and the communication means 4", via radio, will send a communication to the computer 8, in real time, notifying the incidence produced and being able to act accordingly.

In this way, the fire prevention facility is perfectly controlled, so that any incident that occurs in the same is notified in real time to a control center that may be in the maintenance company, in the facilities of the fire prevention facility owner or both, with a 24-hour control.

Thus, when a failure occurs in the facility and it is communicated to the control center 7 by the custom software, the component sending the communication by the incidence produced is detected at the plan of the facility, in which all the components of the same are determined, having it perfectly located.

Simultaneously, the failure warning visual signal, the red LED light, turns on at the corresponding component.

Depending on the size that the fire prevention facility may have, it may incorporate one or more radio relay station 10 for the proper communication of the information.

In addition, on the basis of a system in which the pressure gauges of the different components of the facility are equipped with a LED light and means of communication via radio or equivalent, it is about providing with a battery 15 and wireless transmission (e.g., Bluetooth®) 16 all the pressure gauges 2, while, in addition, the pressure gauges 2 relating to the fire extinguishers 6 are associated with the safety pin 20 of the actuating lever 18 of the same.

In addition, the control system of the fire protection facility has a control center 11 with, at least, one monitoring station 12 of the signal sent by the different components of the facility, and said incidents are communicated, via e-mail, telephone or SMS, to a second computer 13 receiving information from the different components of the facility and this is communicated to the mobile or fixed telephone network, having, at least, one storage database 9 of the plane of the facility to be controlled with the location of the different components of the same.

The system can join up a warning receiving center 18 equipped with a second computer 13 receiving information about the status of the facility will be associated with a keyboard and a screen 17 and may be located in the place of the facility or in a different place as it may be in the maintenance company.

Thus, according to FIG. 1 of the drawings and by way of example, the pressure group 1 is equipped with a pressure gauge 2 provided with a LED light 3, means of communication via radio 4, a battery 15 and wireless transmission (e.g., Bluetooth®) 16.

In this way, If the pressure in the pressure group 1 falls below a certain parameter the warning LED light 3 will be switched on and the means of communication via radio 4 will send a communication to the station 12 of a control center 11, in real time, notifying the incidence produced to be able to act accordingly.

Likewise, the equipped fire hydrants 5 are provided with a pressure gauge 2' also provided with a LED light 3', means of communication via radio 4', a battery 5' and wireless transmission (e.g., Bluetooth®) 6', such that if the pressure of the same is below certain parameter the warning LED light 3' will be switched on and the means of communication via radio 4' will send a communication to the station 12 of a control center 11, in real time, notifying the incidence produced to be able to act accordingly.

In the same way, the different fire extinguishers 6 of the facility are equipped with a pressure gauge 2" provided with a LED light 3", means of communication via radio 4", a battery 5" and wireless transmission (e.g., Bluetooth®) 6", such that if the pressure of any of them is not the optimal, the warning LED light 3" will be switched on and the means of communication via radio 4" will send a communication to the station 12 (first computer) of a control center 11, in real time, notifying the incidence produced to be able to act accordingly.

In this way, the fire protection facility is perfectly monitored, so that any incident that occurs in the same is notified in real time to a station 12 of a control center 11 that will communicate it to a warning receiving center 18 that may be located in the maintenance company, in the facilities of the owner of the fire protection facility or both, with a 24-hour monitoring.

Thus, at the moment of the occurrence of a failure in the facility and after it is communicated to the station 12 of the control center 11 through the customized software, the component that sends the communication caused by the incidence produced is detected on the plane of the facility, properly stored in the database 9, in which all the components of the same are determined, so that its location is known.

Simultaneously with this, the red LED light is turned on, visual signal of the failure of the corresponding component.

In addition, with the object of having complete control of the facility, and in particular of the fire extinguishers 6 or the like, the safety pin 20 of the actuating lever 18 that anchors it with respect to the fixed handle 19, is associated with the pressure gauge 2" to control a possible release of the same.

Thus, in a first practical implementation, the safety pin 20 of the fire extinguisher can fit in a small hole 14 of the pressure gauge 2" being associated with the means of communication 4", such that when the safety pin 20 is released it detects this and sends a communication to the station 12 of the control center 11 of the incidence produced and having perfect knowledge of the fire extinguisher 6 in which the incidence has occurred.

That is, when the safety pin 20 is not in contact with the means of communication, a signal via radio will be emitted to the station 12 of the control center 11 to give notice of the incidence produced.

In a second practical implementation of the invention the safety pin 20 can be linked to a metallic or non-metallic element, such as a strand or wire that will fit in the small hole 14 of the pressure gauge 2" associated with the means of communication 4" to detect manipulation of the same.

This is intended to prevent the release of the safety pin 20 from the actuating lever 18 and the accidental discharge of the fire extinguisher 6 losing efficiency or being rendered unusable.

On the other hand, by providing the pressure gauges of all the components of the facility (pressure group, equipped fire hydrant and fire extinguishers) with wireless transmission (e.g., Bluetooth®) 16, 16', 16", the information concerning the status of the pressure gauge may be obtained "in situ", by means of a tablet, mobile telephone, PDA, or the like in the technical periodic maintenance without relying on the central control system that can be installed in the client's location or in the company responsible for its maintenance.

In addition, the wireless system (e.g., Bluetooth®) can be activated from the control center so that the battery is not consumed except when performing the maintenance.

Depending on the size that the fire protection facility may have, the same may include one or more radio repeaters 16 for the appropriate communication of the information.

Among the different advantages provided by the control system described in the present specification it can be considered:

real time warning of the pressure loss of the elements that make up the fire protection facility, so that the problems encountered can be solved immediately, thus ensuring the proper functioning and effectiveness of the facility;

real time warning of the possible theft of fire extinguishers;

avoiding repairs caused by loss of pressure in the groups between required maintenances;

avoiding possible oblivion by the maintenance company or bad maintenance of fire-fighting equipment, and;

having positioned and controlled the fire prevention components by the software with the plan of the facility, so that if one is moved, the corresponding communication is sent.

obtainment of the status of the pressure gauges of all the components of the facility, by means of a tablet, mobile telephone, PDA or the like;

control of the possible theft or loss of the safety pin of the actuating lever of the fire extinguishers, and;

activation of the wireless system (e.g., Bluetooth®) from the control center when it is going to be used, preventing the consumption of the battery included in the pressure gauges.

In short, it is about being able to remedy any failure of the components of the fire prevention facility immediately when they occur, so that all components are always available.

The invention claimed is:

1. A control system for fire prevention facilities, comprising:

at least one pressure group equipped with a pressure gauge provided with a LED light and radio or wired communication means;

at least one fire hydrant equipped with a pressure gauge provided with a LED light and radio or wired communication means;

at least one fire extinguisher equipped with a pressure gauge provided with a LED light and radio or wired communication means;

a control center with, at least one computer configured to receive information from each communication means, the at least one computer being connected to a fixed or mobile telephone network; and, a storage database of a plan of a fire prevention facility to be controlled, with a location of each pressure group, a location of each fire hydrant and a location of each fire extinguisher;

wherein the control system further comprises a warning receiving center that comprises a second computer configured to receive information from each communication means from a monitoring station of the control center via SMS, e-mail or telephone; the warning receiving center being connected to the fixed or mobile telephone network;

wherein each pressure gauge is provided with a power supply battery and comprises a wireless transmission; and, wherein a safety pin of each fire extinguisher is associated with the pressure gauge of the respective fire extinguisher and wherein the safety pin is either:

inserted, by one end of the safety pin, into a small hole of the pressure gauge of the respective fire extinguisher, the safety pin being in contact with the communication means of the respective fire extinguisher; or connected to the pressure gauge of the respective fire extinguisher by means of an element, and inserted into the small hole of the pressure gauge of the respective fire extinguisher, the safety pin being in contact with the communication means of the respective fire extinguisher.

2. The control system of claim 1, wherein the wireless transmission is a Bluetooth® transmission.

* * * * *